United States Patent [19]

Magnuson

[11] 4,129,300

[45] Dec. 12, 1978

[54] COMPACT GOLF COURSE

[76] Inventor: Arthur P. Magnuson, 1012 W. Burnsville Crosstown, Burnsville, Minn. 55357

[21] Appl. No.: 742,768

[22] Filed: Nov. 18, 1976

[51] Int. Cl.[2] ..... A63B 69/36

[52] U.S. Cl. ..... 273/176 A; 273/176 L

[58] Field of Search .... 273/176 A, 176 AB, 176 AA, 273/176 R, 176 L, 87 C, 87 D, 87 B, 176 D, 176 G

[56] References Cited

U.S. PATENT DOCUMENTS

| | | | |
|---|---|---|---|
| 1,851,423 | 3/1932 | Ely | 273/176 A |
| 2,003,074 | 5/1935 | Gage | 273/176 A |
| 2,455,806 | 12/1948 | Reach | 273/176 A |
| 2,550,480 | 4/1951 | Hubbard | 273/176 AB X |
| 2,846,229 | 8/1958 | Morris | 273/176 AB |
| 3,083,021 | 3/1963 | Reilly | 273/176 AB |
| 3,129,943 | 4/1964 | McKee | 273/176 A |
| 3,156,470 | 11/1964 | Newkirk | 273/176 AB |
| 3,350,099 | 10/1967 | Smart | 273/176 A |
| 3,464,703 | 9/1969 | Vallas | 273/176 A |
| 3,649,027 | 3/1972 | Vallas | 273/176 A |
| 3,685,832 | 8/1972 | Johnson | 273/176 A |
| 3,695,619 | 10/1972 | Brobston | 273/176 A |
| 3,708,173 | 1/1973 | Hewson | 273/176 A |
| 3,719,361 | 3/1973 | Rotolo | 273/176 AB |
| 3,904,209 | 9/1975 | Thomas | 273/176 A |
| 3,904,209 | 9/1975 | Thomas | 273/176 A |

*Primary Examiner*—George J. Marlo
*Attorney, Agent, or Firm*—Frederick E. Lange

[57] ABSTRACT

A compact golf course of a type designed, as much as possible, to simulate all of the features of a full size golf course. The golf course has a set of playing areas surrounding a set of elongated target fairway areas. The number of target fairway areas is substantially less than the desired number of holes and the number of ball hitting areas is substantially greater than the number of target fairway areas. There are a number of target green areas adjacent the target fairway areas which are all identical to each other and are spaced at uniform distances from the ball playing areas. Certain of the ball hitting areas simulate tee or fairway areas and others simulate rough portions of a golf course. The target fairway areas are disposed at an angle with respect to each other. Adjacent each tee area is a sign indicating the total distance for that particular hole and the nature of the approach to the hole. The sign also includes various identifying data so that the player can determine from looking at the position of the ball on the fairway and at the sign how many yards he has driven and how far he has to go to complete the hole. The ball is repeatedly played from various approach areas associated with the hole until the ball lands on or near a green area corresponding to the distance for that hole. The ball is then actually played on an outer green area corresponding in size and shape to the target green areas but located outside the ball hitting areas. Until the ball is actually placed on or near one of these exterior green areas, the ball is always allowed to remain where it stops moving, the ball to be recovered later by attendants of the golf course. It is thus possible to have a number of people simultaneously playing about the periphery of the fairway area without any danger to any of the players.

8 Claims, 9 Drawing Figures

COMPACT GOLF COURSE

BACKGROUND OF THE INVENTION

The game of golf is widely played throughout the world. While it is thoroughly enjoyed by the players, it has two distinct disadvantages. In the first place, the typical golf course requires a large amount of land which must be very carefully maintained when used as a golf course. As available land becomes more scarce, the problem of economically providing adequate suitable land for a golf course becomes more acute. In the second place, because the typical golf course is spread over a good many acres, it requires considerable time to complete a typical game of eighteen holes.

Because of the factors mentioned above, it becomes very expensive of money and time to use a typical golf course for practicing one's game. As a result, numerous "driving ranges" have been constructed. Most driving ranges, however, do not have particularly pleasant surroundings. Few such driving ranges actually have target greens. People using the driving range are forced to use almost any target. Furthermore, in order to be at all realistic, it is necessary to simulate moving forward by repeated shots. This becomes very difficult on the driving range. Furthermore, the driving range to be at all realistic would have to include such things as sand traps and similar hazards which are encountered on a regular golf course. Moreover, while it is desired to minimize the amount of ground that is covered, if a true golf game is to be simulated, it is still desired to have provision for walking from hole to hole and for making approach shots from different angles depending upon where the ball has landed. In the normal driving range, this is impractical.

SUMMARY OF THE PRESENT INVENTION

The present invention is concerned with a compact golf course in which there are two sets of playing areas, one set being in the form of ball hitting areas and the other in the form of elongated target fairway areas and target greens in which one set extends substantially around the other set, the number of target fairway areas being substantially less than the desired number of target holes and the number of ball hitting areas being substantially greater than the number of target fairway areas, and a plurality of target green areas adjacent the target fairway areas and spaced varying distances from the ball playing areas. In the preferred form of the invention, the ball playing areas are outside of and extend substantially around the target fairway areas.

Preferably, the target green areas are all substantially the same in configuration and area so as to present the same appearance to a player regardless of the distance remaining to the target hole. Furthermore, these target green areas are uniformly spaced from each other so that a player is readily able to determine how far his ball has moved down the target fairway area.

Certain of the ball hitting areas are designed to simulate tee or fairway areas and others to simulate rough portions of a golf course, such rough ball hitting areas being disposed adjacent one of the fairway ball hitting areas.

Preferably, each of the target fairway areas is of a length exceeding the largest distance in which a player can normally drive a ball. Thus, any one drive can always be completed on a target fairway area.

The target fairway areas preferably intersect each other with the longitudinal axes thereof being disposed at an angle with respect to each other. This makes it possible to direct a ball down the fairway target area from any of various positions around the periphery of the golf course, giving an illusion of a distinct hole. Furthermore, it aids in the simulation of "dogleg" approaches to a target hole.

In order to aid the players, there is preferably a sign associated with each hole indicating where the tee area is for that hole and indicating the yardage, the par for that hole and the positions of the various green areas.

It is further contemplated there is at least one putting green outside the ball hitting areas, this putting green being of the same configuration and area as the target greens so that when a ball driven from one of the ball hitting areas lands close to the desired target green area, the completion of play for the associated target hole can take place adjacent to and on the putting green without the necessity of the player entering the area into which the balls are being driven from the ball hitting area. Also, the same configuration maintains the reality of simulation.

In playing the game, the player drives the ball from a tee area indicated on the sign for that particular hole. After completion of the drive, the distance travelled is determined by comparing the distance of the ball with landmarks adjacent the fairway area, the distances between which are indicated on the sign for that hole. The player then subtracts the distance driven from the total yardage for the hole and then moves to the ball hitting fairway area indicated on the sign which correlates with and simulates the position to which the ball has come to rest on the target fairway area. The player then shoots for a target green whose distance from the ball hitting area corresponds to the remaining distance. Again, if the drive does not place the ball adjacent to or on the new target green area, the ball is again driven from a fairway hitting area to a new target green spaced from the ball hitting area by the remaining distance. As soon as the player has landed on a target green area or closely adjacent thereto, the play is moved to the putting green and is completed by successive strokes until the ball is actually in the hole. The player then moves near to the tee area for the next hole and after observing the sign associated with that hole, proceeds to repeat the operation just described.

Various further advantages, features and details of my invention will be apparent from a consideration of the accompanying specification, claims and drawing.

DESCRIPTION OF THE PREFERRED EMBODIMENT

Figure 1:
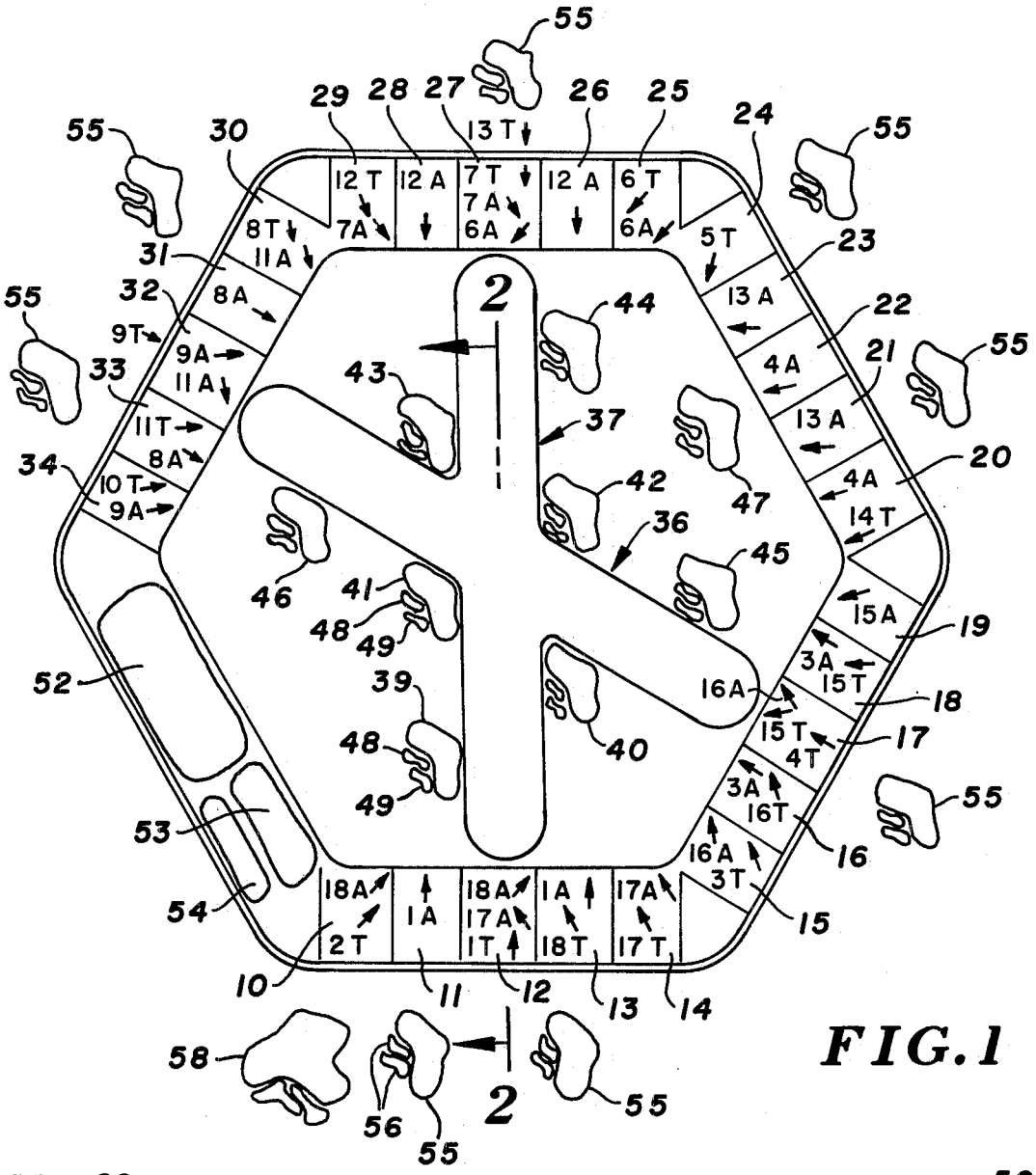
FIG. 1 is a schematic plan view showing one layout of a golf course in accordance with my invention.
Figure 2:
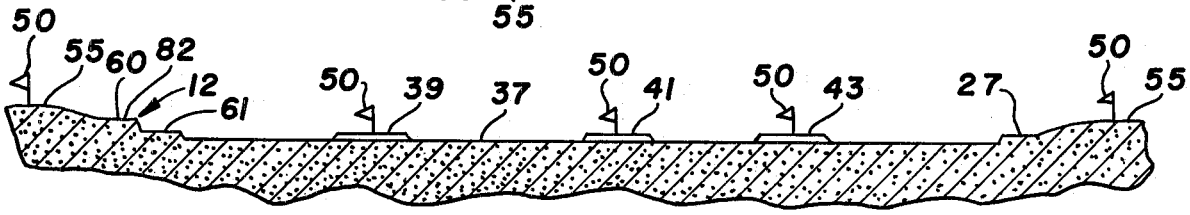
FIG. 2 is a section view taken along the line 2—2 of FIG. 1 showing the relative contour of the various portions of the golf course.

Referring first to FIGS. 1 and 2, the golf course is shown as comprising 25 ball hitting regions designated by the reference numerals 10 through 34. These ball hitting regions surround two target fairway areas 36 and 37 which intersect each other at an acute angle shown as approximately 60°. Spaced along the target fairway area 37 are a plurality of target greens 39, 40, 41, 42, 43 and 44. Target greens 40 and 41, 42 and 43 are likewise disposed adjacent the fairway area 36. In addition, two additional target fairway areas 45 and 46 are adjacent to target fairway area 36. All of these target greens are identical in size and configuration. Furthermore, target greens 39, 41 and 43 are equally spaced from each other as are target greens 40, 42 and 44. Furthermore, target green 40 is half way between target green 39 and 41 as measured along the axis of the fairway area 37. Similarly, target greens 45, 42 and 43 are equally spaced from each other as are target greens 40, 41 and 46. Located adjacent each of the target greens 39 through 46 are sand traps 48 and 49 to simulate sand traps that are present in a full size golf course. In order to ensure that each target green provides a similar playing challenge to the player, the sand traps 48 and 49 are similar in connection with each target green 39 through 46. As indicated in FIG. 2, the target greens are all raised slightly with respect to the fairway strips 36 and 37. Each are provided with a typical target hole and a flag 50 to mark the target hole.

Located in one leg of the area surrounding the target fairways and target greens are driving ranges 52, 53 and 54. The driving ranges can be of varying size. Surrounding the ball playing areas are a plurality of playing greens 55. It will be noted that each of these greens 55 is of the same size and configuration as the target greens 39 through 46. As will be explained later, these playing greens are provided for playing the ball until the hole is made after the ball has landed close to or on one of the target greens 39 through 46. To completely resemble the target greens 39 through 46, the playing greens 55 likewise have sand traps 56 adjacent the greens so that the playing greens 55 require the same type of approach as the various target greens.

It may also be desirable to have a practice green 58 also located outside the ball driving area. The purpose of this is purely to practice putting and has no role in the playing of a game.

As will be noted from FIG. 2, the playing greens 55 are raised substantially above the ball hitting regions 10 through 34. It will also be noted that the ball hitting regions are raised with respect to the fairway areas 36 and 37. Furthermore, as will be apparent from FIG. 2, the ball hitting region has two portions 60 and 61, portion 60 being slightly higher than portion 61. The same is true of all of the ball hitting areas.

Figure 3:
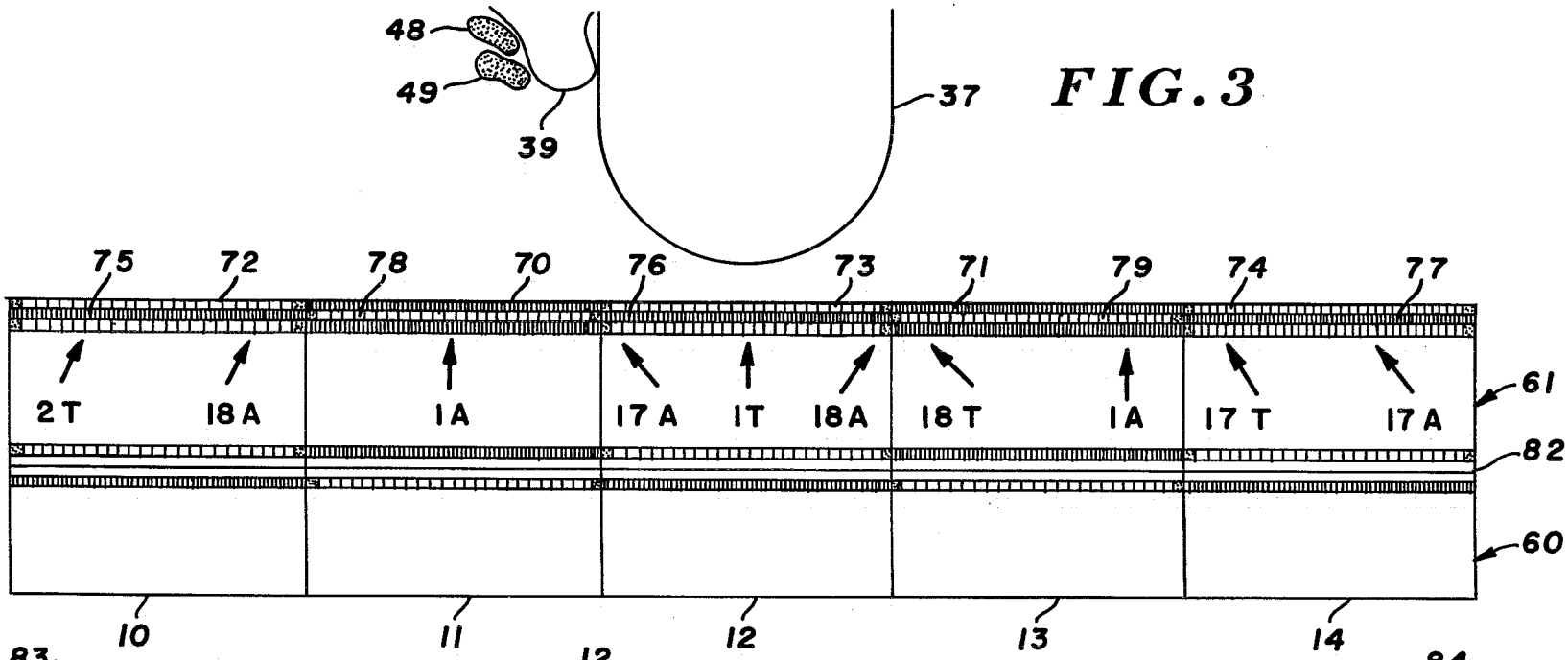
FIG. 3 is a view on a larger scale than in FIG. 1 of one particular group of ball hitting regions.

In the foregoing description, it has been assumed that the ball hitting regions 10 through 34 are all uniform except for one half being raised with respect to the other. In actual practice, each of these ball hitting regions comprises a large number of ball hitting areas. In a typical case, each of the ball hitting regions 10 through 34 is approximately 120 feet square. Each of these regions is divided into approximately 40 three foot strips. Each of these strips consists of alternate "tee" and "fairway" areas. Alternate strips are shown in connection with ball playing regions 10, 11, 12, 13 and 14. In the first row of strips most closely adjacent to the fairway 37, tee areas are indicated by the reference numerals 70 and 71 and the fairway areas by the reference numerals 72, 73 and 74. In the next row, the tee areas are indicated by the reference numerals 75, 76 and 77 and the fairway areas by the reference numerals 78 and 79. It will be readily apparent from the drawing and from the above that the tee areas and fairway areas are alternately staggered in successive rows. In other words, immediately behind the tee area in any one playing region is a fairway area. As indicated above, the ball playing regions are divided into groups on two different levels as indicated in FIGS. 2 and 3 by the reference numerals 60 and 61. In other words, half of the ball playing areas in any one group are at a higher level than those in the other group. The ones to the rear are the ones which are higher and this has the advantage that it tends to compensate for the fact that when the ball playing areas towards the rear farthest away from the greens are being used, the distance which the player must shoot is slightly greater. Since the areas to the rear are slightly higher, the ball has more loft with respect to the target fairway and tends to go further.

Between the two sections 60 and 61 of the greens which, as just explained, are on different levels, is a strip 82 which is designed as a walkway. This strip runs continuously around the entire target area and makes it possible for the player to readily move from one section of the ball hitting area to another as he progresses from hole to hole.

The reason for the large number of parallel ball hitting areas is that it is desirable to provide for a certain amount of rotation of these ball hitting areas. Inasmuch as all of the ball hitting activity is confined to the ball hitting regions 10 through 34 and inasmuch as the present golf course provides for a much larger number of players on it at any one time than is possible with a conventional golf course, the turf in the ball hitting areas is subjected to considerable abuse. By providing approximately 40 ball hitting areas in any one ball hitting region, it is possible to provide for a long period of recuperation for one ball hitting area after it has shown signs of wear and excessive use. It is thus possible with this arrangement to always maintain the grass in an attractive condition in the tee and fairway ball hitting areas despite the heavy use to which the golf course may be put.

Figure 4:
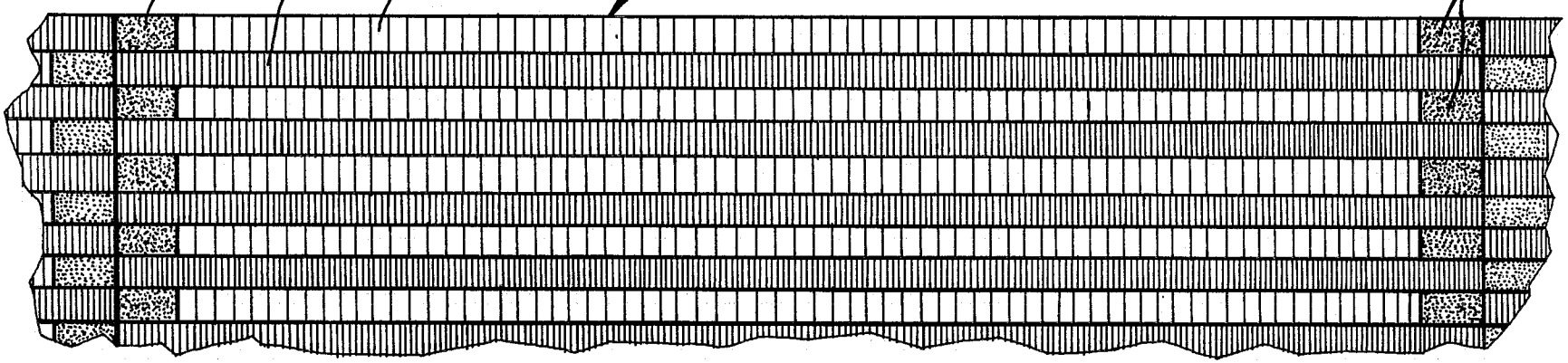
FIG. 4 is a fragmentary view on a still larger scale of a portion of one set of ball hitting regions.

As has been pointed out previously, one of the purposes of the present game is to simulate as closely as possible a real game of golf. One of the challenges in connection with a real game of golf is that of having the ball land in a sand trap. As have been previously pointed out, sand traps 48 and 49 are provided adjacent each target green 39. If the ball should land in one of these sand traps 48 or 49 which is adjacent the final target green associated with the hole in question, then the play is shifted to the outer putting green 55 and the ball placed in the appropriate sand trap 56 associated with that putting green. If, on the other hand, the ball should land in one of the sand traps 48 and 49 associated with some other target green than the one associated with the target hole, then the ball is played from a sand trap area in the ball hitting region. Referring to FIG. 4, it will be noted that there are sand traps 83 and 84 adjacent the end of each of the fairway ball hitting areas. Thus, a sand trap 83 is located at the left hand end of the fairway hitting area 73 whereas sand trap 84 is adjacent the right hand end of this fairway area. If a ball should land in a sand trap associated with a different green than that connected with the target hole, then the ball is placed in one of the sand traps 83 and 84 as closely resembling in position as possible the position of the sand trap in which the ball has landed. The ball is then played from this sand trap in an effort to cause it to approach the desired target green.

Figure 5:
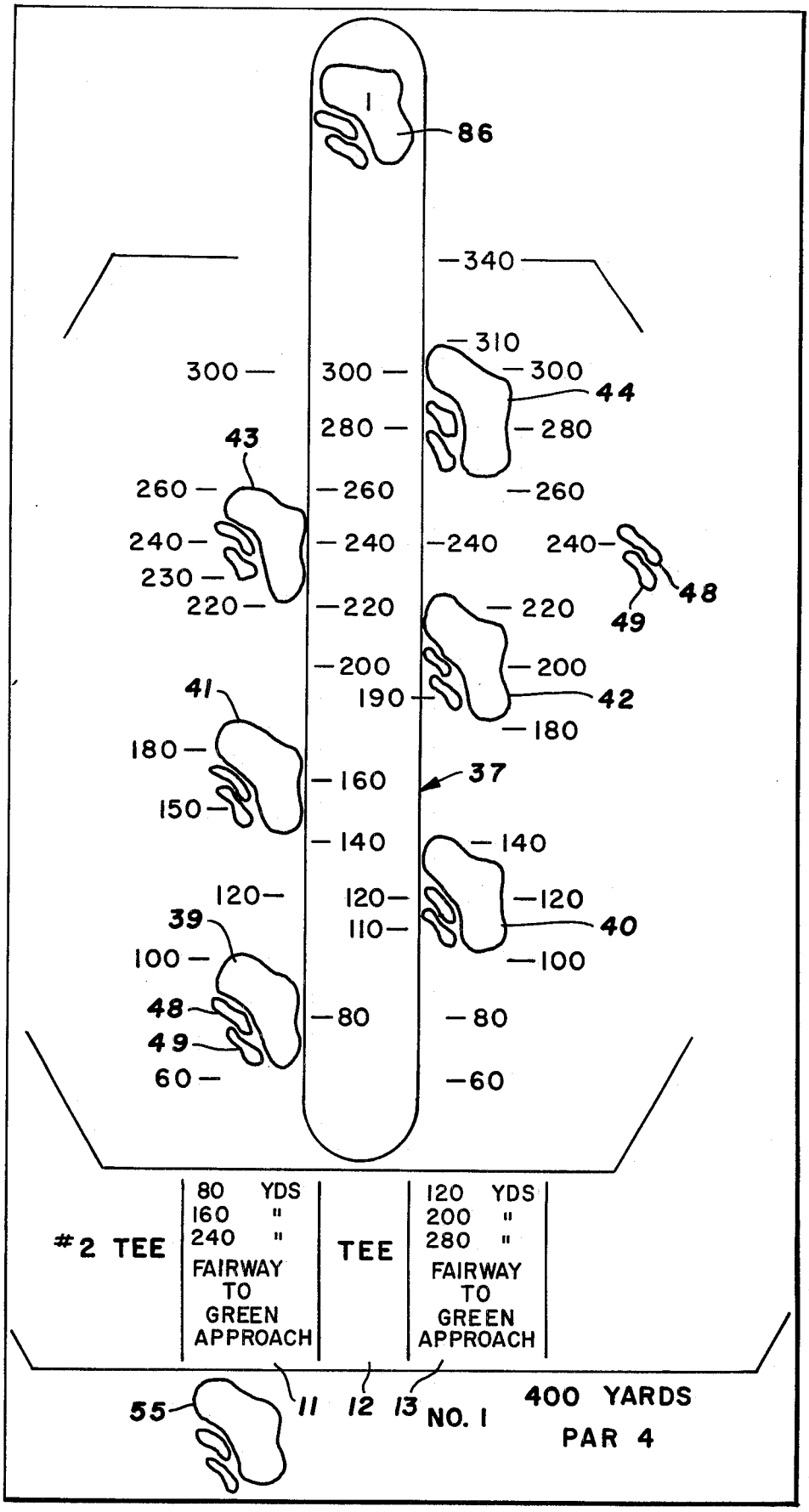
FIG. 5 is a view of a sign indicating the characteristics of the approach to one particular hole, for example, the No. 1 hole.

As has been previously indicated, a sign is provided in connection with each hole of the course to indicate to the player the various distances involved and the general direction of the target green towards which the ball is to be directed. In FIG. 5, I have shown a typical sign of the type which would be displayed in connection with each hole. The sign shown in FIG. 5 is that which would be used in connection with the No. 1 hole, for example. The sign is modified to the extent that reference characters have been added for the purpose of explaining the sign. As is evident from FIG. 1 and from FIG. 3, the ball hitting region 12 is the region containing the ball hitting area from which the ball for the number one hole is teed off. Referring to FIGS. 3 and 4, the ball will be teed off from the tee hitting area 76 or corresponding hitting areas behind it, depending upon which ball hitting areas are in use. This is indicated at or near the bottom of the sign. It will also be clear that one of the two ball hitting regions 11 and 13 are used for subsequent fairway to green approach shots. In other words, referring to FIG. 3, the ball will be hit from one of the two areas 78 or 79 (or equivalent areas) on the approach shot, depending upon which side of the fairway 37 the ball has landed. The view presented to the player by the sign shown in FIG. 5 is a continuous long fairway extending for 400 yards. It is of course impossible to hit this long a drive when the actual fairway 37 is not over 300 yards long. The sign shows a green 86 towards which the ball is to be directed. This green has a numeral "1" on it. Actually, no such green is visible to the player as he steps up to tee off. The green simply is the goal towards which the player is to shoot and the purpose of the sign is to indicate the general direction of the green for hole No. 1 with respect to the point at which the ball is teed off. In an actual golf game, the target green is not always visible, particularly on a long hole. It will be noted further, considering FIG. 5, that the target greens 39, 40, 41, 42, 43 and 44 are visible as are the sand traps 48 and 49 adjacent target green 47. It will further be noted that there are various figures along the depiction of fairway 37 to indicate the distance of various recognizable landmarks from the tee area. For example, if the ball lands on the fairway adjacent the middle of target green 41, the player knows that he has completed 160 yards with his drive and that he has 240 yards to reach the number one hole. It will be readily apparent from FIG. 5 that the layout depicted upon the sign presents to the player a visual layout of the fairway he is to use and all of the landmarks and their distance from the tee area.

Figure 6:
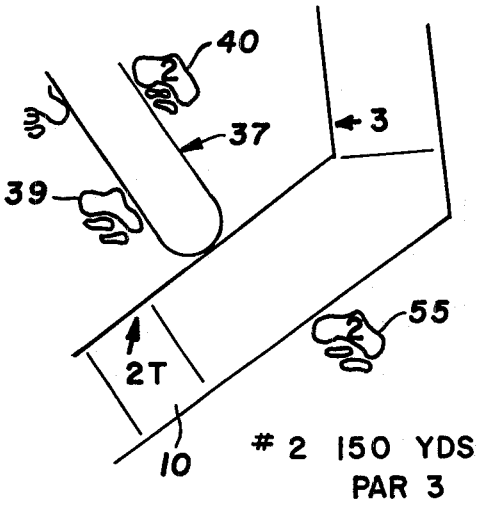
FIGS. 6, 7, 8 and 9 are fragmentary views of portions of the information on signs available for various other holes such as the No. 2 hole, the No. 3 hole, the No. 4 hole and the No. 18 hole.

In FIGS. 6, 7, 8 and 9, there is shown a portion of the material which would appear on various signs in connection with other holes. For example, FIG. 6 shows the significant information in connection with the number two hole, which is only 150 yards long and is a par 3 hole. As can be readily determined from FIG. 1, the tee area for this hole is ball hitting region 10; thus, referring to FIG. 3, the ball would be teed off from the ball hitting area 75 of ball hitting region 10. The target green in this case is target green 40. The arrow shown adjacent the legend 2T in FIG. 1 points towards this target green. The player when he is ready to tee off sees the landmarks depicted in FIG. 6 and ignores the rest of the fairway and target green area. Since the hole is a par 3 hole, the player presumably has a reasonably good chance of landing the ball on or adjacent the target green 40 from his first drive. If he does, he then moves it to the outer putting green 55 which in FIG. 1 happens to be the putting green immediately opposite ball hitting region 13. Even if the ball does not actually land on the green 40, the ball can still be shifted to the general area of putting green 55 shown in FIG. 6 and the play can be continued until the ball lands in the cup. It will be seen from FIG. 6 that even though the hole 2 presents an entirely different type of situation than does hole 1, it is readily possible from observing the sign used in connection with that hole for the player to determine in what direction he should shoot and at what target green he should aim.

Figure 7:
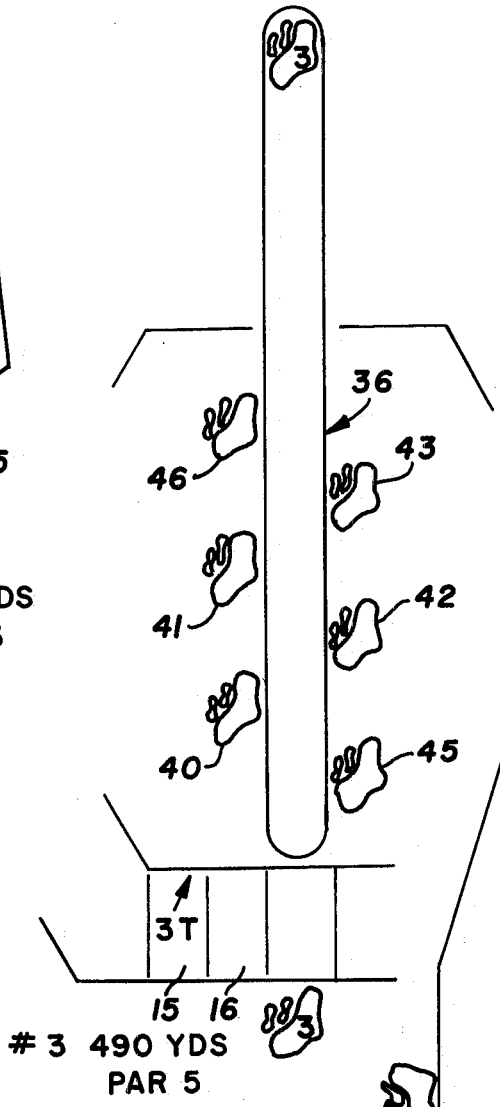

Referring to FIG. 7, this depicts the significant information on the sign in connection with the number 3 hole, which is a par 5 hole. Referring back to FIG. 1, it will be noted that the tee area for this hole is in the ball hitting region 15. The arrow adjacent the legend 3T is pointed towards the end of the fairway 36. Again, since the yardage for the number 3 hole is 490 yards, the target green shown on the sign is an imaginary green since such a green is not actually visible, being beyond the end of the target fairway 36. The player does, however, aim for the fairway 36 and try to get the ball as far down the fairway as possible. It will be noted that the ball is shot at an initial angle with respect to the fairway 36, again introducing the variety into the game that is present in an actual golf game.

Figure 8:
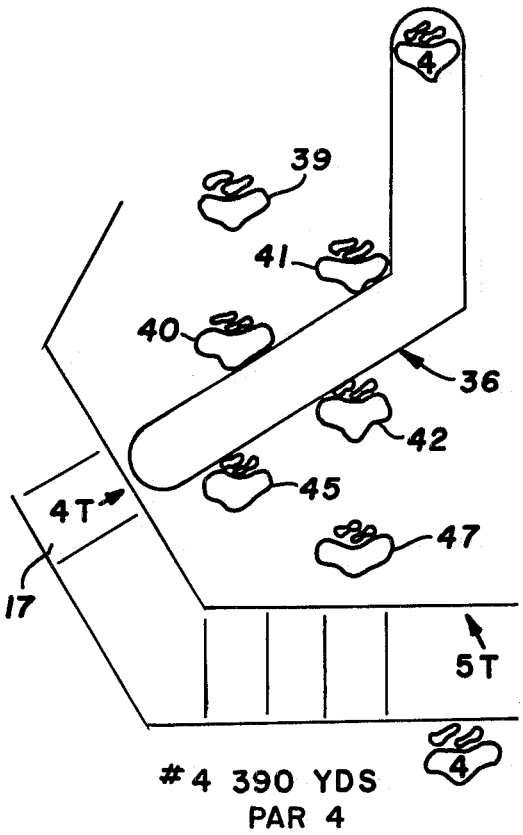

FIG. 8 shows the type of sign that might be used in connection with the number 4 hole. This, as will be noted from the legend, is a 390 yard, par 4, hole and has a dogleg in it. Referring back to FIG. 1, it will be noted that the tee area is in the ball hitting region 17 and the arrow 4T is generally pointed down the direction of the fairway 36. This represents the initial portion of the path over which the ball is to be driven. It will also be noted from FIG. 1 that the arrows adjacent the 4A ball approach hitting areas are in regions 20 and 22 and are directed at quite a different angle than is the arrow adjacent the legend 4T. In other words, after the player completes his initial drive down the fairway 36, he can by reference to the diagram in FIG. 8 determine how many yards he has progressed. He can then subtract this from 390 yards and move to a position in either region 20 or 22 depending upon the position in which his ball has come to rest. The further drives will then be in the direction indicated by the arrows adjacent the legends 4A and towards a target green which is spaced from the ball driving area by the approximate distance remaining. For example, this target green might be either target green 42, target 41 or target green 46, depending upon how far the initial drive has been. When the player lands adjacent any one of those target greens, a ball is then placed on or adjacent the appropriate playing green which in this case is the putting green 55 adjacent the ball hitting region 24.

Figure 9:
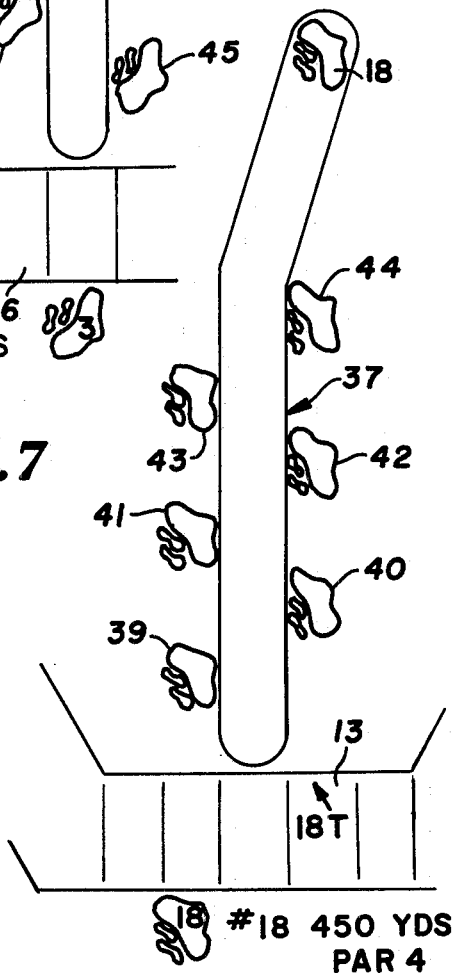

FIG. 9 shows a diagram to be used on a sign for the number 18 hole which, it will be noted, is a 450 yard hole and has a par of 4. Referring to FIG. 1, it will be noted that the tee area for the 18th hole is in ball hitting region 13 and that the area adjacent the legend 18T is directed to a point on the fairway 37. It will also be noted that the fairway approach areas for the 18th hole are in ball hitting regions 10 and 12 and that the arrows adjacent the legends 18A are directed at an angle with respect to the arrow adjacent the legend 18T. In other words, the approach is made at an angle with respect to the original drive. This is indicated in FIG. 9 in which the final portion of the fairway is shown as extending at an angle to the initial portion. In other words, hole 18 is another dogleg hole.

In FIGS. 6, 7, 8 and 9, only a portion of each sign has been shown. As with the sign for hole No. 1 shown in FIG. 5, there will be yardage figures on the sign so that the player can tell by the landmarks adjacent the position of his ball just how far he has driven. These yardage figures have, however, been omitted for purposes of simplicity in FIGS. 6 through 9. It is also to be understood that there will be a sign for each hole of the type shown in FIGS. 5 through 9. Again, it is not believed necessary to show signs for each of the holes. The general direction in which a ball is to be shot for each hole can be determined from a consideration of the arrows in FIG. 1. It is also to be noted that while most of the holes have approach ball hitting areas indicated, this is not true of holes 2, 5, 10 and 14, all of which are par three holes and do not require a separate approach ball hitting area. Presumably, the initial drive will place the ball adjacent the desired target green. From then on, the play can be resumed on the designated playing green 55 for that particular hole.

CONCLUSION

It will be seen that the golf course of the present invention provides for a wide range of situations comparable to that which one encounters in a regular golf course. Not only is the ball initially teed off in different directions depending upon the hole involved but the approach shots are in many cases made along a different course than are the tee shots. In each case, where there is an approach shot, the approach shot can be made from either of two widely spaced positions, depending upon the point on the fairway at which the ball is stopped. The golf course provides such hazards as sand traps which are either adjacent the ultimate target green or adjacent other target greens. Whenever the ball lands in the sand trap other than at the target green, the ball hitting area has sand traps from which the ball can be played to simulate an actual situation. These sand traps are spaced apart so that the sand trap selected can be on the same side of the fairway as is the sand trap on which the ball has landed.

While the overall area occupied by the golf course is relatively small as compared with that of a conventional golf course, it is still possible to accommodate a large number of players without a great deal of interference between players. This is partly due to the disposition of the various ball driving areas with respect to each other. Furthermore, the final approach to the cup is made on an outer playing green so that there are always a certain number of players on these playing greens. The golf course is perfectly safe regardless of the number of players since the player never enters the target fairway or target green area. The balls are allowed to lay and later picked up by attendants. Because of the relatively small overall area occupied by the golf course, the start-up, maintenance, and operation costs are three to five times less than a regular golf course, despite the increased golf capacity.

Because of the large number of ball playing strips, it is possible for a large number of players to use the golf course without deterioration of the course. As pointed out above, players do not enter the target fairway and target tee area; hence, the grass on these areas is relatively undisturbed except by the attendants recovering the balls. In the outer ball hitting areas, there are a large number of parallel ball hitting areas, as pointed out above. At any given time, play takes place along only a few of these ball hitting areas allowing the grass on the rest of the ball hitting areas to recover. As pointed out above, for each ball hitting region, there are 40 different ball hitting areas. This allows ample rotation of the various ball hitting areas. Any time the turf on any one ball hitting area seems to be getting worn or damaged, it is possible to shift the players to anoter ball hitting area and allow the worn turf to be reseeded and to recover.

While the area occupied by the golf course is very small compared with that of a conventional course, it still provides for a substantial amount of exercise because of the fact that the various holes are located at different points in the periphery. Even in the case of one hole, as pointed out, the approach shots may be made at a substantially different location than are the tee shots. Also, there are 18 unique holes; that is, 18 different distances, 18 different elevations and angles from the tee, and 18 different elevations and angles to target greens. The angle and elevation changes give the illustion of a unique golf shot experience on any one of the 18 holes despite the fact that there are only two target fairways and eight target greens.

It will be seen that I have provided a compact golf course, providing a wide variety of playing situations simulating very closely those encountered in playing a conventional golf course. While I have shown a specific embodiment of my invention for purposes of illustration, it is to be understood that the scope of the invention is limited solely by that of the appended claims.

I claim:

1. A compact golf course in which there are two sets of playing areas, one of said sets being in the form of ball hitting areas and the other in the form of elongated target fairway areas, said ball hitting areas extending generally around the target fairway areas, said target fairway areas being in the form of no more than two relatively well defined elongated areas extending substantially across the area between said ball hitting areas and intersecting each other at intermediate portions thereof at an angle with respect to each other, said number of target fairway areas being substantially less than the holes of golf to be played and substantially less than the number of ball hitting areas, and a plurality of target greens along said target fairway areas and spaced varying distances along each fairway area from said ball playing areas.

2. The golf course of claim 1 in which the target greens areas are all substantially the same in configuration and area.

3. The golf course of claim 1 in which certain of said ball hitting areas simulate tee or fairway areas and in which others simuate "rough" portions of a golf course.

4. The golf course of claim 3 in which each "rough" ball hitting area is disposed adjacent one of said tee or fairway ball hitting areas.

5. The golf course of claim 3 in which there is a sign for each target hole adjacent the tee area for that hole indicating the nature of the approach to that target hole including the distances of various landmarks from the ball hitting area.

6. The golf course of claim 1 in which each of the target fairway areas is of a length exceeding the largest distance in which a player can normally drive a ball.

7. The golf course of claim 1 in which there is at least one putting greens outside of said ball hitting areas and said target fairway areas, said putting green being of the same configuration and area as said target greens so that when a ball driven from one of said ball hitting areas lands close to the desired target green "area", the completion of the play for the associated target hole can take place adjacent to and on the putting green without the necessity of the player entering the area into which balls are being driven from said ball hitting areas.

8. The golf course of claim 1 in which the target greens are spaced at uniform distances from each other.

* * * * *